United States Patent [19]

Morris

[11] 4,324,381

[45] Apr. 13, 1982

[54] BEVERAGE CONTAINER SUPPORT

[76] Inventor: Stephen Morris, 399 Fullerton, Apt. 15E, Chicago, Ill. 60614

[21] Appl. No.: 112,696

[22] Filed: Jan. 16, 1980

[51] Int. Cl.[3] ..... A47K 1/08

[52] U.S. Cl. ..... 248/311.2; 248/313; 248/292.1

[58] Field of Search ..... 248/313, 311.2, 302, 248/292.1, 314

[56] References Cited

U.S. PATENT DOCUMENTS

| | | | |
|---|---|---|---|
| 2,747,825 | 5/1956 | Lachenmayer | 248/302 |
| 3,045,962 | 7/1962 | Paulus | 248/314 |
| 3,204,903 | 9/1965 | Stoddard | 248/313 |
| 3,532,318 | 10/1970 | Lloyd | 248/302 |
| 3,840,204 | 10/1974 | Thomas et al. | 248/311 |
| 3,921,948 | 11/1975 | Long | 248/313 |

*Primary Examiner*—Wayne L. Shedd

*Attorney, Agent, or Firm*—Leydig, Voit, Osann, Mayer & Holt, Ltd.

[57] ABSTRACT

A support for holding beverage containers such as glasses, bottles, cups and the like, in an upright position while being used on a boat or moving vehicle. The support is fabricated from three wire elements, one of which forms a pair of opposed uprights interconnected by a transverse wire network that defines a bottom of a container receiving receptacle, the second of which is formed with a plurality of vertically spaced annular rings secured to the uprights and defining the sides of the container receiving receptacle, and the third of which forms a cantilever wall mountable member for pivotably supporting the container receiving receptacle. A screw and grommet arrangement is provided for pivotably and removably mounting the support on the wall.

5 Claims, 5 Drawing Figures

BEVERAGE CONTAINER SUPPORT

DESCRIPTION OF THE INVENTION

The present invention relates generally to beverage supports, and more particularly, to supports for holding beverage containers, such as glasses, bottles, cups, and the like, in an upright position while being used on a boat or moving vehicle.

Various hanging or pivotable supporting devices have been proposed for holding and maintaining beverage containers in upright positions against the tendency of the container to become tilted or upset while being used on a boat or moving vehicle. Such prior devices have included a wire formed container receiving basket or receptacle which is pivotably hung in the boat or vehicle by various means. Such prior devices generally are formed of numerous wire elements which must be welded together at many points during their manufacture. The manufacture and fabrication of such devices, as a result, has been relatively expensive. The ends of such various wire elements forming the support also often terminate or protrude as relatively sharp ends which can hook clothing or scratch a person passing adjacent such support under unstable conditions, as in a boat or moving van. Moreover, in order to provide adequate pivotal support of the beverage container receiving basket, such prior devices have employed relatively complex means for mounting the support on the wall of the boat or vehicle, which further adds to the cost of the device.

It is an object of the present invention to provide a beverage container support which is formed from fewer wire elements and requires less weldments during fabrication than heretofore possible, and thus, lends itself to more economical manufacture.

Another object is to provide a beverage container support as characterized above in which the wire elements are formed and assembled without dangerous or cumbersome protruding ends.

A further object is to provide a beverage container support of the above kind which includes a relatively simple wall mounting arrangement for pivotably supporting the device on a wall or other vertical surface, while permitting the support to be easily removed for compact storage.

Other objects and advantages of the invention will become apparent upon reading the following detailed description and upon reference to the drawings, in which.

Figure 1:
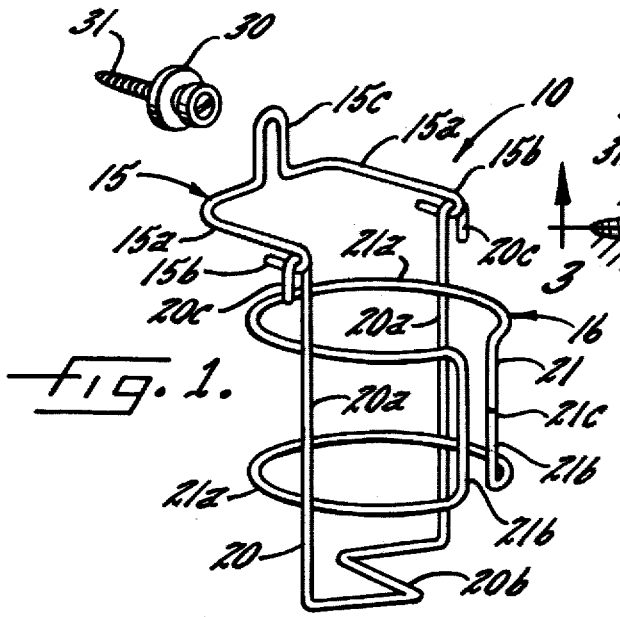
FIG. 1 is a perspective of a beverage container support embodying the present invention, showing the support in a removed condition from its associated wall mounting means.
Figure 2:
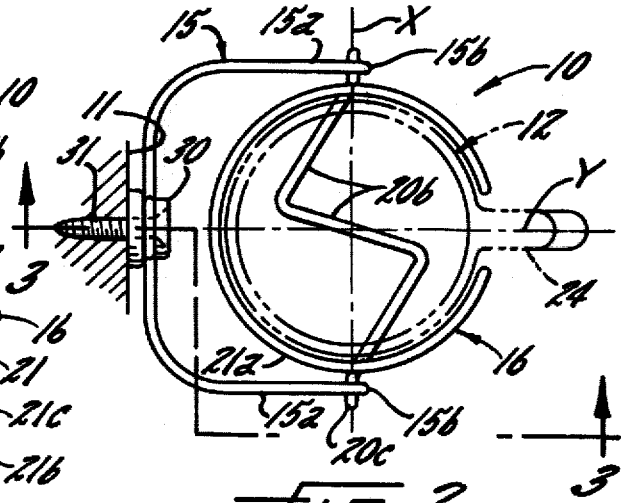
FIG. 2 is a top view of the illustrated beverage container support in mounted position on a wall and holding a cup shown in phantom.
Figure 3:
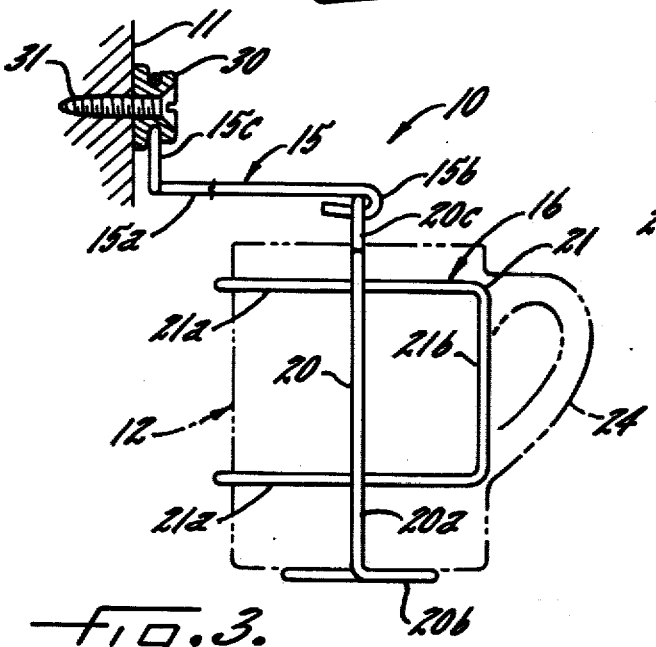
FIG. 3 is a vertical section taken in the plane of line 3—3 in FIG. 2.
Figure 4:
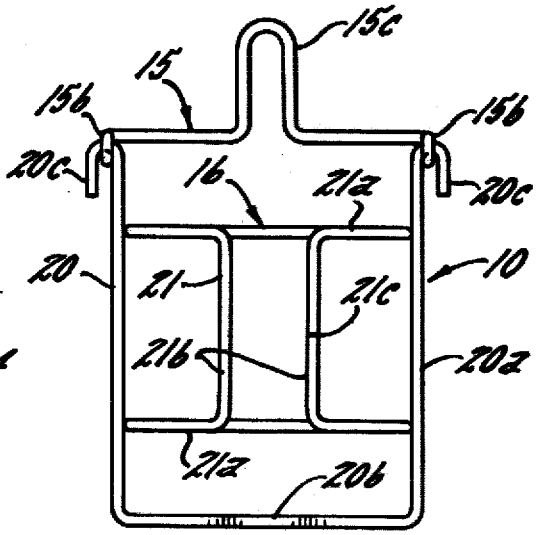
FIG. 4 is a front elevational view of the illustrated beverage container support.

While the invention is susceptible of various modifications and alternative constructions, a certain illustrated embodiment thereof has been shown in the drawings and will be described below in detail. It should be understood, however, that there is no intention to limit the invention to the specific form disclosed, but, on the contrary, the intention is to cover all modifications, alternative constructions, and equivalents falling within the spirit and scope of the invention.

Turning now more particularly to the drawings, there is shown an illustrated beverage container support 10 embodying the present invention supported on a wall 11, which could be any generally vertically oriented surface on a boat, recreational van, or the like. The support 10 in this instance is shown holding a cup 12, indicated in phantom. The beverage container support 10 includes a cantilever member 15 mounted on the wall 11 for pivotal movement about an axis "Y" perpendicular to the wall and a container receptacle or basket 16 hanging from the end of the cantilever member 15 for pivotal movement about a horizontal axis "X" parallel to the wall.

In accordance with the present invention, the beverage container support is formed with three wire elements which permit the support to be economically fabricated without dangerous or cumbersome wire ends protruding out from the device. To this end, the support 10 includes a first wire element 20 formed with a pair of diametrically opposed uprights **20*a* interconnected at their lower ends by a wire network 20*b* which lies in a generally horizontal plane when the support is in mounted position and defines the base of the container receiving receptacle 16. The wire network 20*b* in this case is made by bending an intermediate portion of the first wire element into a zig-zag or "Z" pattern that lies in a common plane perpendicular to the uprights. The upper ends of the uprights 20*a* terminate with downwardly directed hooks 20*c* for suspending the receptacle from the cantilever member 15**, as will be apparent.

For defining the sides of the receptacle 16, a second wire element 21 is formed into a plurality of vertically spaced annular rings **21*a* that are welded to each of the uprights 20*a*. The rings 21*a* are interconnected by spaced vertical segments 21*b* of the second wire element which define a channel for receiving a handle 24 of the cup or other beverage container 12 that is placed in the receptacle. It will be apparent that the angular rings 21*a* and vertical segments 21*b* may be formed from a single wire element with the opposed ends 21*c*** of the wire element in an abutting relation as shown.

A third wire element defines the cantilever member 15, being formed with a pair of spaced arms **15*a* which each terminate in a reversely directed hook 15*b* for pivotably supporting the hooks 20*c* of the first wire member. To facilitate mounting of the cantilever member 15 on the wall 11, the third wire member 15 is formed with a generally U-shaped downwardly opened loop portion 15*c*** intermediate its ends.

In keeping with the invention, screw and grommet means are provided for easily and removably mounting the support on the wall or other vertical surface and for guiding pivotal movement of the support in a plane parallel to the wall. In the illustrated embodiment, there is shown an annular grommet 30 formed with a groove about its periphery for receiving and supporting the U-shaped loop portion **15*c* of the third wire element. The grommet 30 preferably is made of a plastic material that permits easy pivoting of the wire cantilever member 15** relative to the grommet.

To facilitate mounting of the grommet 30 on the wall, it is formed with a central axial bore through which a wall engaging screw 31 may be placed. The grommet 30 preferably is formed with a countersunk bore for receiving the tapered head of the screw 31 such that no sharp edges exist in the mounting. It will be seen that the grommet not only permits easy pivoting of the cantilever member 15 relative to the wall, but the annular groove of the grommet also guides such movement so as to maintain it in a plane parallel to the wall.

Figure 5:
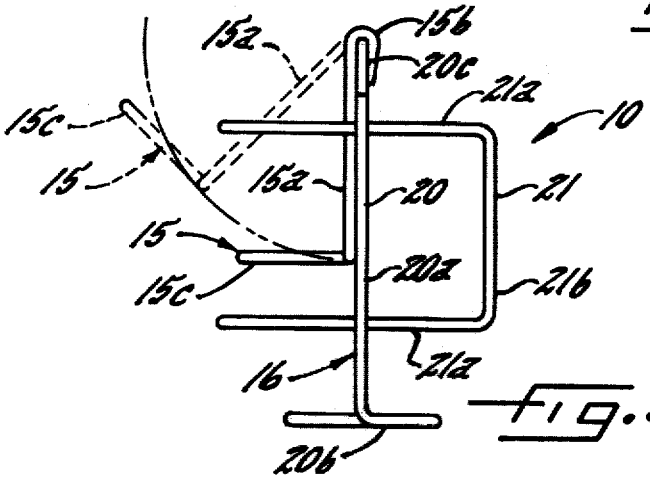
FIG. 5 is a side elevational view showing the beverage container support removed from its mounting means with the cantilever support member thereof shown pivoted to a stored position.

When the support 10 is mounted in such manner on the wall or other vertically oriented surface of a boat, recreational van, or other moving vehicle, it will be seen that jarring, tilting or rocking movement of the boat or vehicle will be absorbed by the dual pivotal support of the beverage holding receptacle 16, the receptacle being pivotable in a plane perpendicular to the wall and also in a plane parallel to the wall. Such a dual pivotal support arrangement will tend to prevent significant tilting or upset of a container held therein, even under relatively extreme rocking conditions that might exist on a boat. It will be seen, however, that when the need for such beverage support ceases to exist, such as when the boat is docked or beverages are not being served, the support may be easily removed from its mounting grommet by simply lifting the loop 15*c* of the cantilever member 15 off the grommet 30. The cantilever member 15 may thereupon be pivoted downwardly to a generally vertical position within the receptacle 16, as illustrated in FIG. 5, for relatively compact storage of the support.

In view of the foregoing, it can be seen that the beverage container support of the present invention is formed with relatively few wire elements and requires only four weldments, and thus, lends itself to economical fabrication and manufacture. The wire elements also are formed and assembled so as to essentially eliminate dangerous or cumbersone protruding ends customarily existing in such wire fabricated devices. The beverage container support further includes a relatively simple wall mounting arrangement for pivotably supporting the device on a vertical surface, while permitting it to be easily removed for compact storage.

I claim as my invention:

1. A beverage container support comprising a first wire element formed with a pair of diametrically opposed uprights interconnected at their lower ends by a wire network which lies in a generally horizontal plane and forms the base of a container receiving receptacle, said wire network of said first wire element being formed to include a portion that lies transversely of a line extending between said uprights, said uprights of said first wire element each terminating in a hook, a second wire element forming a plurality of vertically spaced annular rings secured to said uprights and defining sides of said container receiving receptacle, a third wire element having a pair of spaced arms that terminate with means for supporting the receptacle formed by said first and second wire elements by said first hooks for pivotal movement relative to said third wire element in a first direction of movement, and said third wire element being formed with hanger means from which said support may be hung for pivotal movement in a second direction of movement.

2. The beverage container support of claim 1 in which said hanger means is a generally U-shaped downwardly opened loop formed in said third wire element intermediate the ends thereof.

3. The beverage container support of claim 1 in which said second wire element is formed to define a vertical slot in said spaced annular rings for receiving the handle of a beverage container placed in the receptacle defined by said first and second wire elements.

4. The beverage container support of claim 2 including means removably and pivotably mounting said support on a wall, said mounting means including an annular plastic grommet that is mountable on the wall and formed with a peripheral groove for supporting said U-shaped loop of said third wire element and guiding pivotal movement of said support in a plane parallel to said wall.

5. The beverage container support of claim 4 in which upon removal of said support from said mounting means said third wire element is pivotable about said second wire element hooks to a position within the receptacle defined by said first and second wire elements for compact storage.

* * * * *